US008960209B2

(12) United States Patent
Büsing et al.

(10) Patent No.: US 8,960,209 B2
(45) Date of Patent: Feb. 24, 2015

(54) DISHWASHER AND INLET BOLT

(75) Inventors: Johannes Büsing, Emersacker (DE); Christian Mesarosch, Augsburg (DE); Werner Oblinger, Bergheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 811 days.

(21) Appl. No.: 13/267,160

(22) Filed: Oct. 6, 2011

(65) Prior Publication Data

US 2012/0090653 A1 Apr. 19, 2012

(30) Foreign Application Priority Data

Oct. 13, 2010 (DE) ..... 10 2010 042 410

(51) Int. Cl.
*B08B 3/00* (2006.01)
*A47L 15/42* (2006.01)

(52) U.S. Cl.
CPC ..... *A47L 15/4217* (2013.01)
USPC ..... 134/200; 134/56 D; 134/57 D; 134/58 D; 134/18; 134/186; 137/216.1; 137/312; 137/387; 137/15.18; 137/897

(58) Field of Classification Search
CPC ..... A47L 15/4217; A47L 15/4221; A47L 15/4225; A47L 15/4223; A47L 2501/01
USPC ..... 134/56 D, 57 D, 58 D, 18, 186, 200, 179, 134/172, 198, 95.3; 137/216.1, 312, 897; 239/251, 248, 261, 264, 461
See application file for complete search history.

(56) References Cited

U.S. PATENT DOCUMENTS 7,270,132 B2 * 9/2007 Inui et al. ..... 134/56 D
7,614,409 B2 * 11/2009 Han et al. ..... 134/56 D
7,931,034 B2 * 4/2011 Mack et al. ..... 134/176

FOREIGN PATENT DOCUMENTS

DE 102007052084 * 5/2009 ..... D06F 39/08
DE 102007052084 A1 5/2009

OTHER PUBLICATIONS

Fetzer et al., "Water-guiding household device" DE 10 2007 052 084, Machine Translation.*

* cited by examiner

*Primary Examiner* — Michael Barr
*Assistant Examiner* — Thomas Bucci
(74) *Attorney, Agent, or Firm* — James E. Howard; Andre Pallapies

(57) ABSTRACT

A dishwasher includes a wash tub enclosing an interior and a clean water feed line which passes through a port of the wash tub into the interior. The feed line has a line end leading from outside to the wash tub. An inlet bolt can be fastened from the interior to the line end and has an axial bore to extend the feed line. The axial bore leads into a plurality of inlet openings which are distributed over a circumference on a circumferential surface of the inlet bolt projecting into the interior. The inlet bolt has an end which faces the interior and is implemented as a cover to protect the axial bore from ingress of splash water.

18 Claims, 5 Drawing Sheets

Fig. 6
(PRIOR ART)
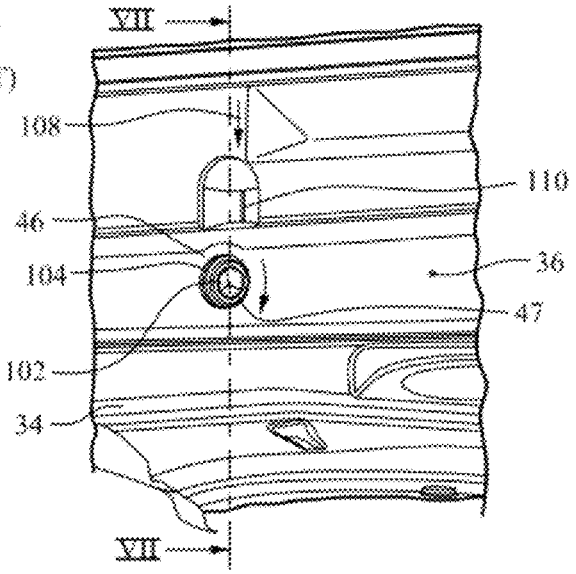
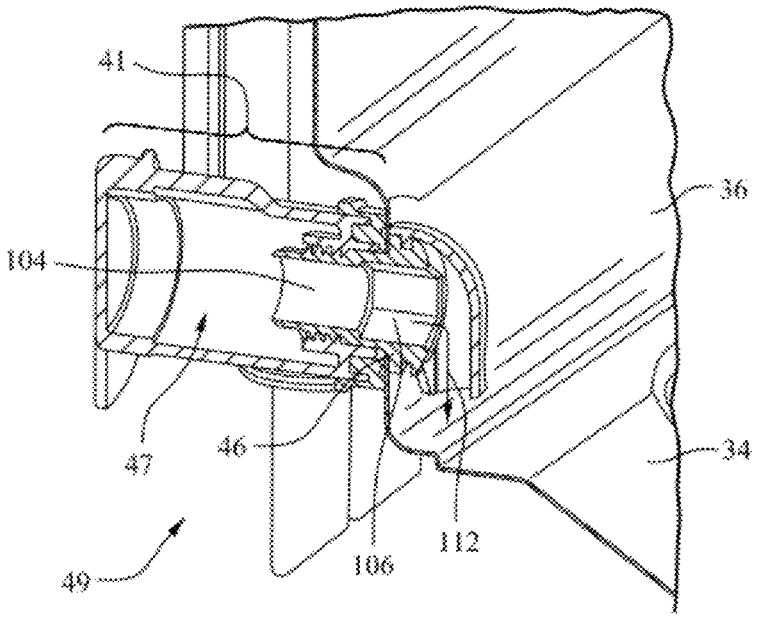
Fig. 7
(PRIOR ART)

DISHWASHER AND INLET BOLT

BACKGROUND OF THE INVENTION

The invention relates to a dishwasher and an inlet bolt for such a dishwasher.

A dishwasher, in particular a domestic dishwasher, has a wash tub enclosing an interior. The interior contains e.g. crockery baskets in which the dishes to be washed are placed, and water spray arms which during the cleaning process apply washing liquid to the entire interior in order to clean the dishes located there. FIG. 5 shows a known wash tub 34 (here only the sidewalls and base). FIG. 6 shows the detail VI from FIG. 5, FIG. 7 essentially a section along the line VII-VII through FIG. 6. In order to deliver clean water to the interior 36 of the wash tub 34 e.g. at the start of a wash, the wash tub 34 has a port 46 through which a clean water feed line 47 is inserted. The feed line 47 leads, for example, from a heat exchanger 49 located outside the wash tub 34, in particular a storage tank, which can be filled with clean water, preferably cold water, preferably in the intermediate wash cycle or preferably at or after the end of the intermediate wash cycle of the wash cycle of a dishwasher program to be executed, into the interior 36 where it ends in an inlet opening 102 through which the clean water can flow into the interior. Said heat exchanger 49 is in heat-conducting contact with a wall of the wash tub 34 in order to promote, during the drying cycle of the respective dishwasher program, the condensation into droplets of liquid of the hot steam present in the wash tub after the last liquid-conveying wash sub-cycle, particularly rinsing, by providing a surface that is cooler than the wash tub interior.

It is known to implement the feed line 47 in two sections. It then has a line end 41 essentially outside the wash tub 34, i.e. leading from outside to the wash tub 34. As a second section, an inlet bolt 104 is screwed through the port 46 into the line end 41 from the interior 36. The inlet bolt 104 has an axial bore 106 in the direction of a central longitudinal axis of the bolt, thereby continuing the feed line 47 from the exterior of the wash tub 34 to its interior 36. The term "axial bore" is to be understood here in particular as including any arbitrarily shaped, i.e. also e.g. curved, cavity allowing water to flow through the feed line. The wash tub 34 is expediently pressed between the inlet bolt 104 and line end 41, particularly with the interposition of a gasket (not shown). However, other designs are also conceivable here which do not involve the wash tub 34 being pressed therebetween. The inlet bolt 104 is fitted using an Allen key on the correspondingly hexagonal shaped axial bore 106 from the interior 36. The inlet bolt is also termed the water inlet screw.

This on the one hand provides a seal between the interior and the exterior in the region of the port while at the same time mechanically fixing the feed line at the port or rather in the wash tub. A corresponding dishwasher, in particular an inlet bolt of this kind, is disclosed in DE 10 2007 052 084 A1, for example.

In practice, either no clean water is fed through the feed line to the interior of the wash tub during the respective liquid-conveying wash sub-cycle, such as e.g. the cleaning cycle, of the wash cycle of a dishwasher program selected or, expressed in general terms, of the respective washing or cleaning operation of the dishwasher, or at most clean water is fed through the feed line to the interior of the wash tub only prior to or at the start of the respective wash sub-cycle for wash bath changing and/or only during a refill phase for adding to or mixing an existing wash bath quantity of the respective liquid-conveying wash sub-cycle, such as e.g. the pre-wash cycle or cleaning cycle, whereas no clean water flows in through the feed line during the remaining time of the respective wash sub-cycle of a dishwasher program selected. Particularly during the phases in which no clean water is fed in, dirty water, grease or dirt particles detached from the items to be washed can get into the axial bore or more specifically the feed line and the heat exchanger. Over the course of time, the feed line or even the upstream water heat exchanger may thus become contaminated or fouled with grease. For this reason it is known, after final installation of the inlet bolt in the dishwasher, as shown in FIG. 6, to place a cover cap 110 onto the inlet bolt in the direction of the arrow 108.

The cover cap must be fitted after final installation of the screwed-in inlet bolt 104, as the latter's rotational position after final mounting is not predictable. Due to the shape of the cover cap 110, the flow direction of inflowing clean water is diverted downward in the direction of the arrow 112. The cover cap also prevents the ingress of dirty water, grease and foreign bodies into the axial bore 110.

BRIEF SUMMARY OF THE INVENTION

It is an object of the invention to specify an improved dishwasher with an improved inlet bolt.

This object is achieved by a dishwasher 1 and an inlet bolt contained therein as claimed in claim 1 and claim 9 respectively. Other advantageous embodiments and further developments of the invention are set forth in the sub-claims. A dishwasher as described above is equipped with a modified, namely inventive, inlet bolt. In the finally assembled state, the latter's axial bore, at its circumferential surface projecting into the interior, ends in a plurality of inlet openings distributed over the entire circumference of the bolt. The end of the inlet bolt facing the interior is additionally implemented as a cover protecting the axial bore from splash water ingress.

In other words, the function of the abovementioned hitherto subsequently fitted cover cap is replaced by the cover integrally provided in the inlet bolt, i.e. the bolt itself incorporates the cover, an additional cap being superfluous. The covering function hitherto performed by the cap is therefore already implemented on the bolt itself prior to the fixing of the bolt in the line end, i.e. is provided thereon as early as the bolt manufacturing stage prior to installation.

As the inlet openings are distributed over the circumferential surface of the inlet bolt, particularly in the region of its end section projecting into the interior of the wash tub, water can flow out in different radial directions of the inlet bolt. The final position or more specifically rotational position of the bolt after final installation in the line end has no effect of any kind on its function. For by means of the plurality of inlet openings provided around the outer circumference of the inlet bolt it can be ensured in particular that, irrespective of the rotational angle of the inlet bolt, one of its inlet openings will always permit water outflow downward to the bottom of the wash tub.

As is also achieved with the cover cap used hitherto, the axial bore is covered in the axial direction. The plurality of inlet openings distributed over the circumference can be made small enough to ensure that no appreciable amounts of liquid and/or dirt particles can penetrate upstream from the interior of the wash tub into the duct of the inlet bolt and into the duct of the feed line to which the inlet bolt is coupled.

In particular, it may be expedient if, according to an advantageous variant of the inventive design of the inlet bolt, in particular of the water inlet screw, said bolt is implemented such that a single-section water inlet is provided in the wash tub and advantageously does not require an additional cover cap. Such an end-face cover incorporated in the inlet bolt protects the feed line duct behind it, i.e. the axial bore and also the feed line section farther upstream, against fouling by inflowing or splashing water or dirt residues.

Simply transferring the above mentioned principle, i.e. implementing the known cover cap in one piece with the bolt, will fail, because the final rotational position once the bolt has been screwed in is not known and, in the worst case scenario, the inlet opening might point upward, so that dirty water running down the sidewall would virtually collect in the feed line.

The advantages of this expedient design of the water inlet include the fact that, for installation, instead of the two parts required hitherto, namely the inlet bolt and the cover cap, only a single inlet bolt, i.e. a single part, is required. This reduces the installation time. By dispensing with the cover cap, the inlet bolt can be of slimmer design, i.e. with less overall height extending into the interior than the known cover cap. This has the advantage that e.g. in the case of a thinner, i.e. narrower dishwasher, in particular e.g. only 45 cm wide, a larger bottom spray arm can be used if the water inlet is again located centrally in the wash tub (as shown in FIG. 5) and the spray arm is located at the level of the water inlet, i.e. of the port 46. This in turn improves the washing performance of the dishwasher by increasing the effective radius of the outer jet of the spray arm.

In a preferred embodiment of the invention, the inlet bolt can comprise a basic body containing the axial bore and a cover spaced axially away—toward the interior in the installed state—from the basic body. The inlet openings are then constituted by the space provided between the basic body and the cover. In other words, the inlet bolt has a basic body and a lid forming its end facing toward the interior of the wash tub, which cover is connected to the basic body e.g. via axial bars and/or ribs, in particular running essentially parallel to the central axis of the through-duct of the inlet bolt. At the in particular freely projecting front end of the inlet bolt there is advantageously mounted a front plate or cover plate extending essentially parallel to the wash tub wall containing the port for the inlet bolt. The inlet openings are delimited in particular by the basic body, lid and the bars. The bars are e.g. snap-ins or plug-ins which are advantageously formed on both the basic body and cover during manufacture of the inlet bolt and are interlocked or inserted into one another to fix the cover to the basic body.

In this advantageous embodiment, the cover and basic body can, for example, be manufactured in particular as two individual parts and assembled to form the inlet bolt prior to final installation in the dishwasher. By manufacturing two separate injection molded parts it is advantageously possible, for example, to implement the internal radii of the axial bore and inlet openings in an optimal manner, i.e. optimally to prevent blockage and having low flow resistance for the inflowing clean water.

In another advantageous embodiment of the invention, the inlet bolt is produced in one piece. In other words, the basic body and cover are fabricated integrally. For example, during manufacture the two bolt sections are fabricated adjacent to one another and in particular connected by a living hinge, preferably in an injection molding process. The inlet bolt then preferably consists of two main segments, namely the basic body and the cover, which are interconnected by means of a living hinge. After injection molding and prior to installation in the dishwasher, the cover is swung onto the basic body via the living hinge and engages in corresponding ribs or snap-ins, thereby completing the inlet bolt. The inlet bolt therefore only comprises a single part which is injection molded open and then folded together and locked. Said folding together and locking can also be implemented in the injection molding die itself However, the basic body and cover can also be fabricated as two separate parts and appropriately assembled to form the bolt prior to final installation in the dishwasher.

Alternatively, however, the component can be injection molded from a single piece, wherein some radii in particular inside the inlet bolt cannot be suitably formed as in the case of the advantageous solution just mentioned. In other words, the bolt is then produced in one piece in a single injection molding as a complete finished part.

In another advantageous embodiment, the inlet bolt can be fixed in the line end by rotation about its central longitudinal axis. This can be implemented, for example, by a bayonet mechanism, but in particular by a screw thread mount. The inlet bolt then has e.g. a male thread, the line end a matching female thread. The inlet bolt is then advantageously screwed into the line end by rotating it about is central longitudinal axis. For this purpose, the inlet bolt is advantageously implemented with a rotationally symmetric shape or structure, in particular circular cylindrical to a first approximation.

For this purpose the inlet bolt advantageously has engagement means for an assembly tool. In the case of the embodiment with screw thread, the inlet bolt has, for example, engagement means for a standard tool, e.g. a screwdriver, wrench, or socket. The inlet bolt can then be screwed into the wash tub of the dishwasher at its feed line, without additional action, by engagement with the assembly tool in a single operation. To this end, the engagement means faces toward the dishwasher interior when the bolt is in the installed state.

In an advantageous variant of this embodiment, the engagement means can be formed by an outline shape or contour of at least part of the bolt that is compatible with the assembly tool. For example, the front end of the inlet bolt facing the interior in the installed state is polygonal, e.g. hexagonally, but not circularly shaped, so that e.g. a standard Allen key can be used to grip the inlet bolt in a form-fit manner with respect to the direction of rotation and screw it into the line end or rather tighten it.

In particular, the above mentioned lid can, for example, be made e.g. hexagonal as engagement means for the assembly tool. The force is then transmitted to the basic body via the above mentioned bars or ribs which in particular provide a form-fit and/or force-fit, additionally or independently thereof possibly also a metallurgically-bonded connection between cover and basic body.

In another advantageous embodiment, the inventively implemented inlet bolt has an inlet region which, in the installed state, is spaced apart from the wash tub by a tube section, only the inlet region having the inlet openings. In other words, the inlet openings therefore have a certain stand-off distance, formed by the tube section, from the inner wall of the wash tub. As during the washing process dirty water flows in particular down the sidewall, i.e. the inner wall of the wash tub, it first flows via the tube section which, however, has no inlet openings at all, so that dirty water cannot reach the inlet openings. This prevents dirty water from being forced back into the openings and therefore e.g. into a heat exchanger.

In another advantageous variant of this expedient embodiment, the inlet region can be radially enlarged compared to the tube section. Once the inlet bolt is installed, its axial direction generally runs horizontally, as it is generally located in an approximately vertical section of the sidewall. In other words, this produces, when the inlet bolt is installed, a kind of drain channel enclosing the circumference of the bolt in the region of the tube section, so that runoff water is even better prevented from running in the axial direction of the bolt, i.e. from the inner wall to the inlet openings, and from entering said openings.

In a preferred variant of this advantageous embodiment, the tube section is radially necked-down compared to the region of the inlet bolt adjacent to the wash tub. This likewise results in the above mentioned effect of a drain channel between inner wall and inlet openings of the inlet bolt in order to prevent the ingress of dirty water. In particular, e.g. a tapering-in can be provided between a bearing surface of the bolt on the wash tub and a hexagonal head of the bolt.

As said tube section or the necking-down formed each extend in particular in an essentially rotationally symmetric manner over the circumference of the inlet bolt, its ultimate rotational position after final installation is irrelevant. Dirty water can always run off the bolt, or rather ingress into the inlet openings is largely prevented. In particular, the plurality of inlet openings provided in a distributed manner around the outer circumference of the inlet bolt ensure that, irrespective of the angle of rotation of the cover plate or cover disk, one of the inlet openings always allows water discharge downward to the bottom of the wash tub. In particular, for this purpose two adjacent inlet openings can be disposed mutually offset by approximately the same angle of rotation.

In another preferred embodiment, the inlet bolt continues the feed line, holding the wash tub pressed between them. This ensures a particularly secure seating of the feed line in the wash tub or rather particularly effective sealing of the port with respect to the feed line.

Apart from e.g. in the cases of obvious dependences or incompatible alternatives, the advantageous embodiments and/or further developments of the invention explained above and/or in the subclaims can be used individually or in any combination with one another.

The invention can of course also be used analogously for other domestic appliances, also those conveying or supplying any liquid medium other than clean water to an interior.

BRIEF DESCRIPTION OF THE DRAWINGS

The invention and its advantageous embodiments and/or further developments as well as the associated advantages will now be explained in greater detail with reference to the accompanying schematic drawings in which:

FIG. 6 shows the detail VI from FIG. 5 according to the prior art,

FIG. 7 shows the section VII-VII from FIG. 6 according to the prior art.

DETAILED DESCRIPTION OF EXEMPLARY EMBODIMENTS OF THE PRESENT INVENTION

Figure 1:
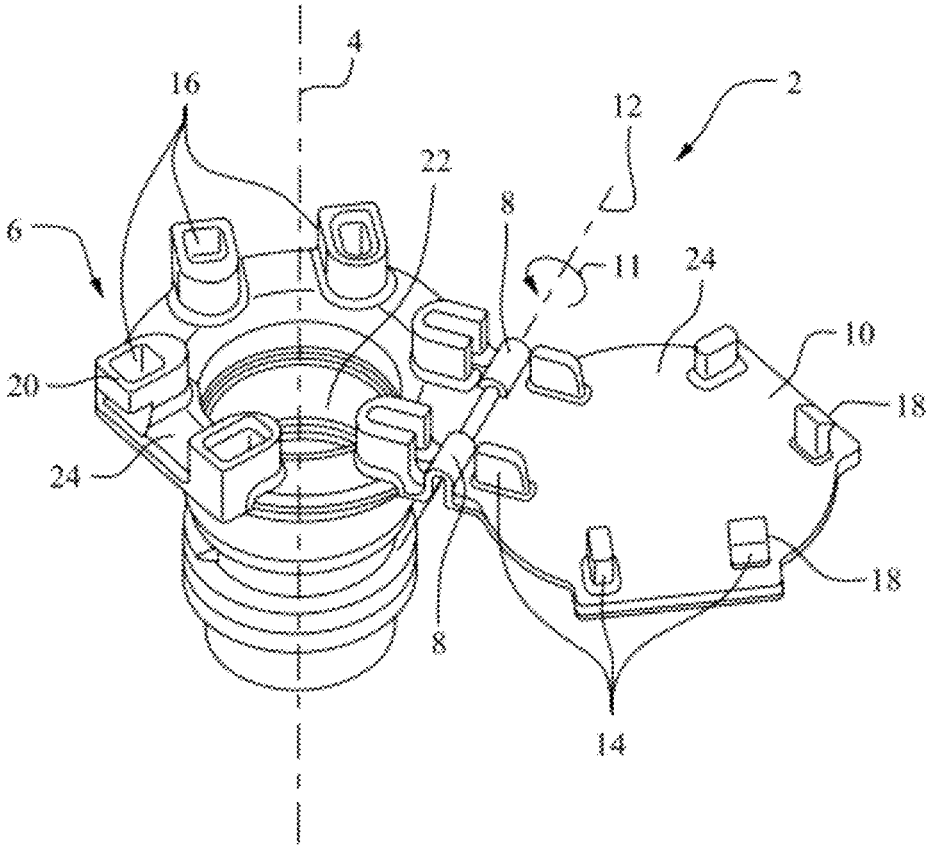
FIG. 1 shows a one-piece inlet bolt produced by injection molding as an advantageous embodiment of an inventively designed inlet bolt.
Figure 5:
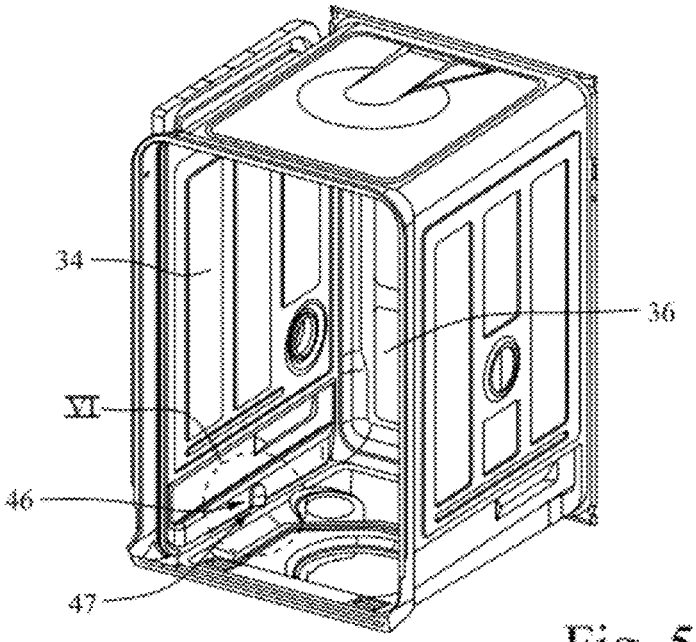
Fig. 5 (PRIOR ART)
FIG. 5 shows a wash tub with water inlet according to the prior art.

FIG. 1 shows an inventive inlet bolt 2 having a central longitudinal axis 4. The inlet bolt 2 is here in particular produced in one piece as an injection molded part, but is not shown in its finished form in FIG. 1. That is to say, the bolt has two parts which are not yet in their final position. The inlet bolt 2 has a basic body 6 constituting a first part and, as a second part, a lid 10 connected thereto via living hinge 8. In order to complete the inlet bolt 2 prior to installation in a dishwasher, the lid 10 is swiveled onto the basic body 6 in the direction of an arrow 11 about the pivot axis 12 of a living hinge 8. Ribs 14 disposed on said lid 10 engage in a form-fit manner in corresponding receptacles 16 on the base section 6. Some of the ribs 14, in the example the two opposite the living hinge 8, are equipped with snap-in lugs 18. These then snap into corresponding latching mechanisms 20 on the basic body 6 in order to hold the lid 10 securely on the basic body 6. Running along the central longitudinal axis 4 in the basic body 6 is an axial bore 22 which, as known from the prior art (FIG. 5-7), continues the feed line 47 in order to enable clean water to flow into a dishwasher.

Figure 2:
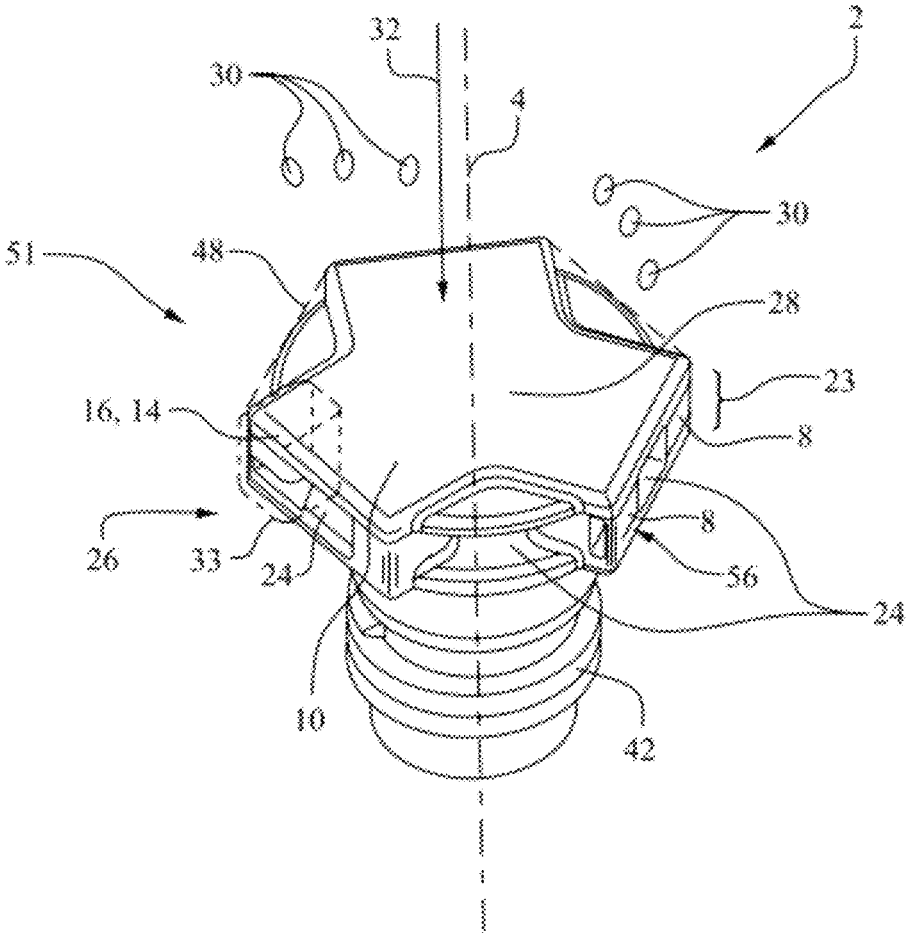
FIG. 2 shows the inlet bolt from FIG. 1 in its finished form.

FIG. 2 shows the inlet bolt 2 in its completed state, i.e. ready for final installation in a dishwasher. The axial bore 22 now leads into inlet openings 24 which are distributed over the circumferential surface 26 of the inlet bolt 2. In this example a total of six inlet openings 24 are present which are formed between the respective ribs 14 and receptacles 16, the lid 10 and the base section 6. Only three of the inlet openings 24 are visible in FIG. 2. The creation of the inlet openings 24 between basic body 6 and stand-off lid 10 and as outlet openings of the axial bore 22 is also again visible as in FIG. 1. The inlet openings 24 are the respective spaces between the ribs 14 and the receptacles 16. In other words, the inlet openings 24 are therefore formed by a space 23 produced between lid 10 and basic body 6 as a result of the stand-off ribs 14. The lid 10 therefore constitutes a cover 28 which protects the axial bore 22 against splash water 30 in the direction of the arrow 32, i.e. prevents the ingress thereof.

According to an alternative embodiment, the inlet bolt 2 is already injected molded in the finished form shown in FIG. 2, and therefore has no living hinges 8. The respective connecting ribs 14 and corresponding receptacles 16 and living hinges 8 are then not present, being replaced by solid integrally molded connecting pieces. One such is shown in FIG. 2 as a dashed cube. Connecting pieces of this kind are then disposed at all six positions, in particular those visible in FIG. 1, of the ribs 14 and their associated receptacles 16.

Figure 3:
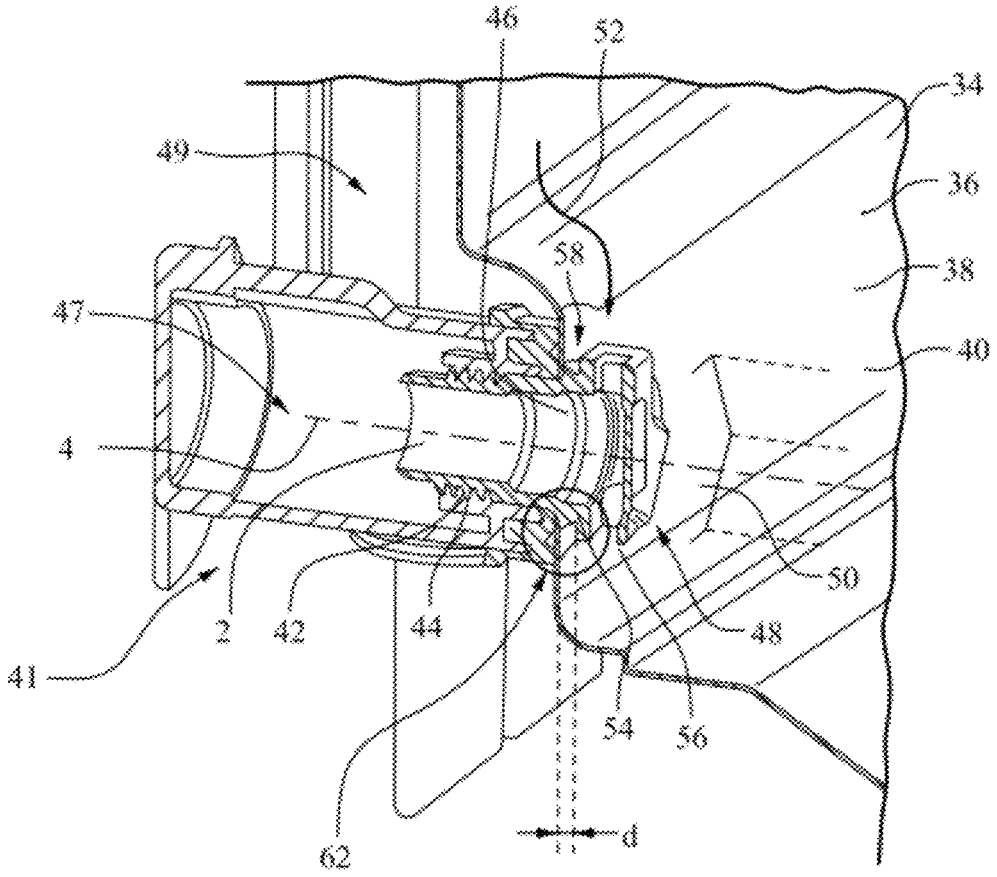
FIG. 3 shows a section through the inlet bolt from FIG. 1 finally installed in the dishwasher.

Corresponding to FIG. 7 for the dishwasher 32 known from the prior art, FIG. 3 shows a section of its wash tub 34. The surface of the sidewall 38 facing the interior 36, i.e. its inner side 40, is visible. However, here the inlet bolt 2 implemented according to the inventive design principle is fixed in its final mounting position to the end 41 of the feed line. The central longitudinal axis 4 runs horizontally, as the sidewall 38 runs vertically in the region of the port 46. The inlet bolt therefore continues the feed line 47 or rather forms it with the aid of its axial bore 22 and the inlet openings 24.

It can be seen from FIG. 3 that the inlet bolt 2 is also provided with a male thread 42 on the basic body 6 in order to engage in a female thread 44 of the line end 41. Here too, as in the prior art, the wash tub 34 is clamped between the line end 41 and the inlet bolt 2 in particular in a form-fit and/or force-fit manner and pressed against a gasket (not shown) inserted in the line end 41 in order to seal the port 46 of the wash tub 34 against water leakage. The line end 41 is part of a heat exchanger 49 for heating the incoming clean water in the feed line 47. The heat exchanger is in particular a storage tank which can be filled with clean water, preferably cold water, preferably in the intermediate wash cycle or preferably at or after the end of the intermediate wash cycle of the wash cycle of a dishwasher program to be executed. Said heat exchanger is preferably in heat-conducting contact with a wall of the wash tub in order to promote the condensation, i.e. into droplets of liquid, of the hot steam present in the wash tub after the last wash sub-cycle, in particular rinse cycle, by providing a cooler surface compared to the wash tub interior during the drying cycle of the respective dishwasher program.

FIG. 3 shows a schematically indicated assembly tool 50, namely a standard socket—size 22 in the example. This is used to install the inlet bolt 2 in the line end 41. The assembly tool grips the inlet bolt 2 or rather its end facing the interior 36 in a rotationally fixed manner with respect to the central longitudinal axis 4. For this purpose the lid 10 and also the adjacent part of the basic body 6 is implemented in a preferably hexagonal shape 48 and more generally produces a form fit for the assembly tool 50, thereby providing an engagement means 51 on the inlet bolt 2 for the assembly tool 50. FIG. 2 also illustrates how the lid 10 has the hexagonal outline shape 48, indicated by a dashed line, which form-fits into the inner outline shape of an Allen key. The inlet bolt 2 can thus be screwed into the line end 41, i.e. tightened.

FIG. 3 also shows that, in the finally installed state of the inlet bolt 2, the inlet openings 24 have a stand-off distance d from the inner side 40 of the sidewall 38. The inlet bolt 2 namely has a tube section 54 of axial length d extending between the sidewall 38 and an end-face inlet region 56 of the inlet bolt. The tube section has openings. The inlet openings 24 are provided in the inlet region 56 only.

Although water running down the inner side 40, indicated by an arrow 52, thus comes into contact with the tube section 54 projecting from the sidewall 38 toward the interior 36, it does not come into contact with the inlet openings 24. In an embodiment not shown, the tube section 54 can be made cylindrical, in particular essentially circular-cylindrical in shape, i.e. having an essentially constant radius with respect to the central longitudinal axis 4. However, in the alternative embodiment shown in FIG. 3, the tube section 54 is necked-in radially compared to the region 62 of the inlet bolt 2 adjacent to the wash tub 34, here in particular tapered in radius. This alone produces a channel 58 which receives dirty runoff water flowing in the direction of the arrow 52 and drains it from the inlet bolt 2 in the circumferential direction. The flow of dirty water in the axial direction of the inlet bolt 2, i.e. toward the inlet openings 24, is made more difficult. This would also even apply to an expedient embodiment (not shown) of the inlet bolt 2, the inlet region 56 of which is of essentially the same diameter as the rest of the inlet bolt.

However, the Figures show another advantageous embodiment: The inlet region 56 carrying the inlet openings 24 is additionally radially widened compared to the rest of the inlet bolt 2. This produces an even more clearly and effectively implemented channel 58 between the inlet region 56 and the wash tub 34.

Figure 4:
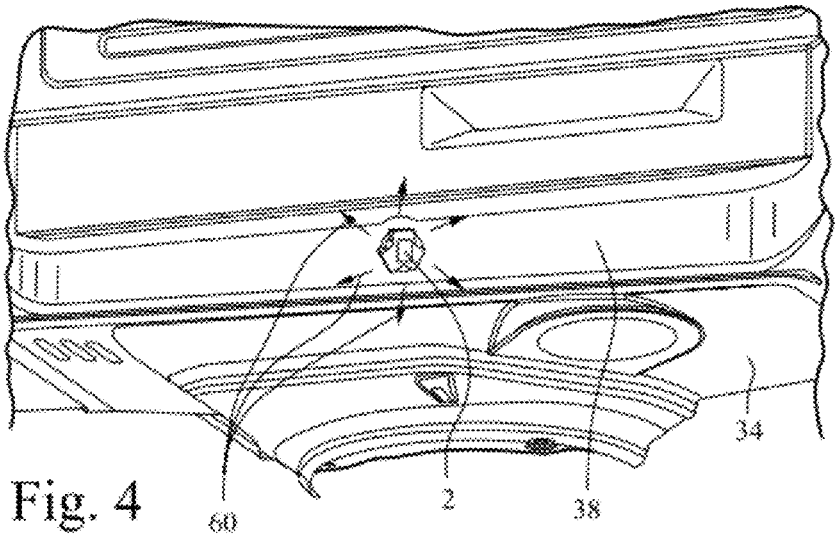
FIG. 4 shows a perspective view of the finally installed inlet bolt from FIG. 1.

FIG. 4 again shows the inlet bolt 2 from FIG. 3 in the complete finally installed state. The arrows 60 indicate the outflow directions for the clean water entering the wash tub 34.

What is claimed is:

1. A dishwasher, comprising:

a wash tub enclosing an interior;

a clean water feed line passing through a port of the wash tub into the interior, said feed line having a line end leading from outside to the wash tub; and an inlet bolt securable from the interior to the line end and having an axial bore to extend the feed line, wherein the axial bore leads into a plurality of inlet openings distributed over a circumference on a circumferential surface of the inlet bolt projecting into the interior of the wash tub, said inlet bolt having an end facing the interior and implemented as a cover to protect the axial bore from ingress of splash water.

2. The dishwasher of claim 1, wherein the inlet bolt includes a basic body incorporating the axial bore, said cover being spaced axially away from the basic body, with the inlet openings being formed by a space between the basic body and the cover.

3. The dishwasher of claim 1, wherein the inlet bolt is produced in one piece.

4. The dishwasher of claim 1, wherein the inlet bolt is securable in the line end by rotating the inlet bolt about its central longitudinal axis, said inlet bolt having an engagement member for engagement of an assembly tool.

5. The dishwasher of claim 4, wherein the engagement member has at least one part which is formed by an outline shape matching an outline shape of the assembly tool.

6. The dishwasher of claim 1, wherein the inlet bolt has an inlet region which is spaced away from the wash tub by a tube section, said inlet region containing the inlet openings.

7. The dishwasher of claim 6, wherein the inlet region is radially widened compared to the tube section.

8. The dishwasher of claim 6, wherein the tube section is necked-in radially compared to a region of the inlet bolt adjacent to the wash tub.

9. The dishwasher of claim 1, wherein the inlet bolt continues the feed line with the wash tub pressed therebetween.

10. An inlet bolt for a dishwasher, said inlet bolt being securable from an interior of a wash tube to a line end of a clean water feed line passing through a port of the wash tub, said inlet bolt having an axial bore extending the feed line and leading into a plurality of inlet openings distributed over a circumference on a circumferential surface of the inlet bolt projecting into the interior of the wash tub, said inlet bolt having an end facing the interior and implemented as a cover to protect the axial bore from ingress of splash water.

11. The inlet bolt of claim 10, comprising a basic body incorporating the axial bore, said cover being spaced axially away from the basic body, with the inlet openings being formed by a space between the basic body and the cover.

12. The inlet bolt of claim 10, wherein the inlet bolt is produced in one piece.

13. The inlet bolt of claim 10, further comprising an engagement member for engagement of an assembly tool to fasten the inlet bolt in the line end by rotating the inlet bolt about its central longitudinal axis.

14. The inlet bolt of claim 13, wherein the engagement member has at least one part which is formed by an outline shape matching an outline shape of the assembly tool.

15. The inlet bolt of claim 10, wherein the inlet bolt has an inlet region which is spaced away from the wash tub by a tube section, said inlet region containing the inlet openings.

16. The inlet bolt of claim 15, wherein the inlet region is radially widened compared to the tube section.

17. The inlet bolt of claim 15, wherein the tube section is necked-in radially compared to a region of the inlet bolt adjacent to the wash tub.

18. The inlet bolt of claim 10, wherein the inlet bolt continues the feed line with the wash tub pressed therebetween.

* * * * *